US010914164B2

(12) United States Patent
Zou et al.

(10) Patent No.: US 10,914,164 B2
(45) Date of Patent: Feb. 9, 2021

(54) HIGH-EFFICIENCY PRE-DRILLING PRESSURE METER TEST APPARATUS AND METHOD FOR DEEP ROCK MASS

(71) Applicant: CHINA UNIVERSITY OF GEOSCIENCES (WUHAN), Wuhan (CN)

(72) Inventors: Junpeng Zou, Wuhan (CN); Yuyong Jiao, Wuhan (CN); Zeyang Wu, Wuhan (CN); Aiguo Yao, Wuhan (CN); Fei Tan, Wuhan (CN); Yi Cheng, Wuhan (CN); Jin Luo, Wuhan (CN); Hao Wang, Wuhan (CN); Guohua Zhang, Wuhan (CN)

(73) Assignee: CHINA UNIVERSITY OF GEOSCIENCES (WUHAN), Wuhan (CN)

( * ) Notice: Subject to any disclaimer, the term of this patent is extended or adjusted under 35 U.S.C. 154(b) by 107 days.

(21) Appl. No.: 16/377,309

(22) Filed: Apr. 8, 2019

(65) Prior Publication Data

US 2019/0316462 A1 Oct. 17, 2019

(30) Foreign Application Priority Data

Apr. 13, 2018 (CN) ..... 2018 1 0333039
Apr. 19, 2018 (CN) ..... 2018 1 0365266

(51) Int. Cl.
*E21B 47/06* (2012.01)

(52) U.S. Cl.
CPC ..... *E21B 47/06* (2013.01)

(58) Field of Classification Search
CPC ..... E21B 47/117; E21B 47/06; E21B 49/006
See application file for complete search history.

(56) References Cited

U.S. PATENT DOCUMENTS 4,733,568 A * 3/1988 Koopmans ..... E02D 1/022 73/784
2005/0257960 A1* 11/2005 McGregor ..... E21B 49/10 175/24

* cited by examiner

*Primary Examiner* — Brad Harcourt
(74) *Attorney, Agent, or Firm* — Hemisphere Law, PLLC; Zhigang Ma

(57) ABSTRACT

A high-efficiency pre-drilling pressure meter test apparatus for deep rock mass includes a rigid drill pipe, a probe, a pressurizing device and a signal processing device. The rigid drill pipe, comprising a top end and a tail end opposite to the top end, receives a fluid medium. The probe is connected with the tail end of the rigid drill pipe and communicates with the rigid drill pipe. The probe includes a measuring chamber. The fluid medium flows from the rigid drill pipe to the measuring chamber. The pressurizing device is connected to the top end of the rigid drill pipe and applies pressure to the fluid medium. The signal processing device is electrically connected with the probe to detect deformation of the measuring chamber with the change of the pressure and volume of the fluid medium in the pressurizing device.

16 Claims, 6 Drawing Sheets

HIGH-EFFICIENCY PRE-DRILLING PRESSURE METER TEST APPARATUS AND METHOD FOR DEEP ROCK MASS

CROSS-REFERENCE TO RELATED APPLICATIONS

This application claims priority to Chinese Application No. 201810333039.3 filed on Apr. 13, 2018 and Chinese Application No. 201810365266.4 filed on Apr. 19, 2018, the contents of which are incorporated herein by reference.

TECHNICAL FIELD

The subject matter herein generally relates to geotechnical mechanics technology field, especially for a high-efficiency pre-drilling pressure meter test apparatus for deep rock mass and a method of same.

BACKGROUND

Pressure Meter Test (PMT) is usually used in an investigation of physical and mechanical parameters of geotechnical foundation. PMT is a horizontal load test, principle of which is that: placing a pressure meter in a vertical borehole, applying pressure to the outer membrane of the pressure meter, and soil or rock surrounding the vertical borehole is deformed through an expansion of the pressure meter, and the stress-strain characteristics of soil or rock is determined. Advances in deep drilling technologies, like hydraulic fracturing and geothermal mining, urgently needs to accurately grasp the in-situ mechanical properties of deep rock masses (e.g., great than 500 m). However, the existing pressure meter and corresponding method could not meet the requirements of deep-hard-rock mass exploration. In a prior art, a pre-drilling pressure meter used in a PMT exists defects as follows:

Firstly, a pre-boring pressure meter is mostly suitable for clay soil, silt soil, sand soil, gravels, residual soil or soft rock. During a PMT, a qualified vertical hole need to be drilled in advance, and then the pressure meter should be put into the vertical hole at a design depth, and then the PMT is conducted. However, the in-situ formation is so complicated that the pre-drilling pressure meter is very likely to be stuck by crushed stone, and the flexible pipes cannot provide an appropriate downward thrust to make the pre-boring pressure meter at the design depth.

Secondly, flexible plastic (or nylon-fiber) is used to make elastic membrane of the pre-boring pressure meter. However, flexible plastic (or nylon-fiber) pipe is easily deformed under high fluid pressure. Especially at a large buried depth (e.g., great than 500 m), a long pipeline is required, and the pipeline will generate a great deformation under high pressure. In addition, the deformation of rock mass is significantly affected by pressure changes, which greatly affects the accuracy of geophysical parameters calculation. Moreover, the flexible pipe will bend in the drilling hole under gravity, which affects the positioning accuracy of the target formation, especially when the target formation is deep and thin.

Thirdly, the elastic membrane of a conventional pre-boring pressure meter could only withstand a low pressure, especially that of the pressure meter with a single chamber. As shown in FIG. 1, the membrane of pressure meter with a single chamber will uniformly deform within a lower pressure range. However, when the pressure is high, the membrane of the single-chamber pressure meter will extend outward at both ends, thereby failing to obtain a true volume change of the rock or soil. Moreover, this phenomenon becomes more and more obvious with the increase of the hardness of rock or soil, resulting in errors in the calculation of the data of side pressure modulus, yield pressure, limit pressure and so on.

Fourthly, existing elastic membrane of the pre-boring pressure meter has the disadvantages of high cost and short service life. After several cycles of expansion and shrinkage, the elastic membrane will be damages seriously. Therefore, it needs to replaced frequently. In addition, in a target location, with the increasing of test pressure and the expansion of elastic membrane, the risk of elastic membrane being destroyed by surrounding crushed stone increases. The mechanical properties of the target rock or soil could not be obtained accurately, and a lot of manpower and material resources will be consumed.

Therefore, there is room for improvement within the art.

BRIEF DESCRIPTION OF THE DRAWINGS

Implementations of the present technology will now be described, by way of embodiments only, with reference to the attached figures.

DETAILED DESCRIPTION

Figure 1:
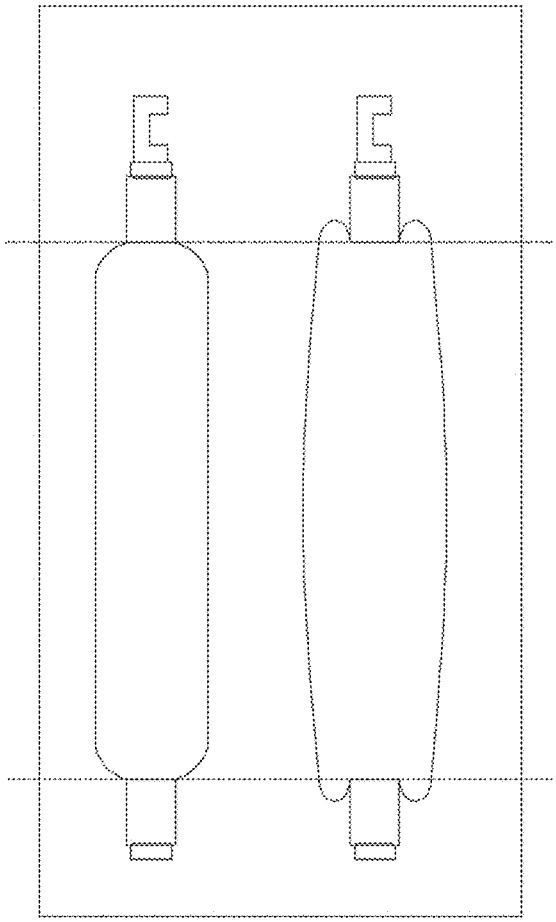
FIG. 1 is an elastic membrane of a pressure meter testing apparatus at an original state (left) and a state diagram under a pressure to generate a deformation (right) in a prior art.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to illustrate details and features of the present disclosure better. The disclosure is illustrated by way of embodiments and not by way of limitation in the figures of the accompanying drawings, in which like references indicate similar elements. It should be noted that references to "an" or "one" embodiment in this disclosure are not necessarily to the same embodiment, and such references mean "at least one."

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like. The references "a plurality of" and "a number of" mean "at least two."

FIG. 1 illustrates a pressure meter testing apparatus 100. The pressure meter testing apparatus 100 includes a rigid drill pie 5, a probe 2 located at a tail end of the rigid drill pipe 5, a pressurizing device 10 and a signal detection and transmission unit 7.

The rigid drill pipe 5 is a hollow shape and includes a hollow cavity to receive fluid medium 6. The fluid medium 6 can be water. The bottom end of the probe 2 is conical. During a pressure meter testing, one end of the rigid drill pipe 5 protrudes from the ground, and the other end inserts into a stratum layer. The rigid drill pipe 5 can also be include a plurality of sub-drill pipes 51 connecting sequentially, and the upper end of the uppermost sub-drill pipe 51 protrudes from the ground, and the remaining drill pipe 5 is located in stratum layer. That is the total length of drill pipes 5 which is able to adjust according to depth of the actual target location. In this embodiment, the rigid drill pipe 5 includes two sub-drill pipes 51, and the two sub-drill pipes 51 are connected to each other by threads. The rigid drill pipe 5 is able to withstand a great external force, and the probe 2 locates at bottom end of the rigid drill pipe 5, thereby, when the probe 2 put into a target detection location in a formation, a positioning accuracy of the probe 2 can be guaranteed.

In the embodiment, connections at each two adjacent sub-drill pipes 51 is provided with a gasket 1. The gasket 1 is used to prevent water leakage at connections of each two adjacent sub-drill pipes 51. The gasket 1 is made from nitrile rubber and provided with a through hole at the central thereof to permit the fluid medium 6 flow to the probe 2.

Figure 4:
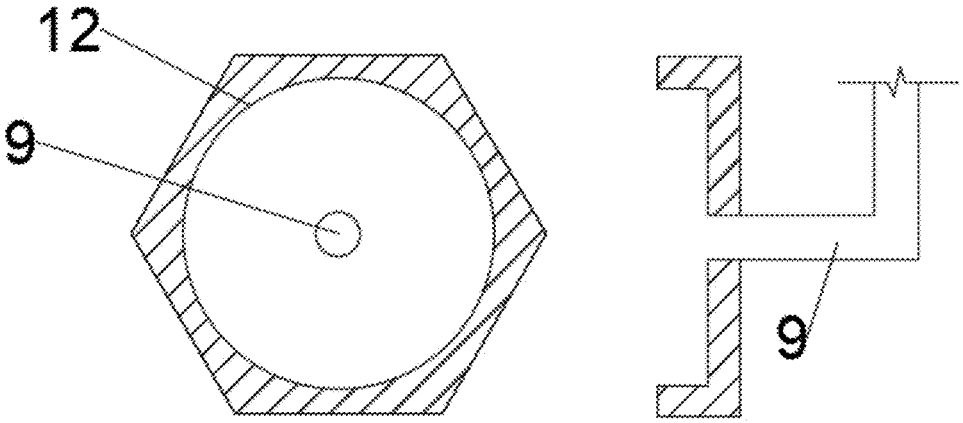
FIG. 4 is a top view of a bolt at left and a cross-section of the bolt at right of FIG. 2.

The top end of the drill pipe 5 is provided with a bolt 12, as shown in FIG. 4. The bolt 12 has a through hole. The through hole of the bolt 12 is configured to connect the pressurizing device 10 to the rigid drill pipe 5.

Figure 2:
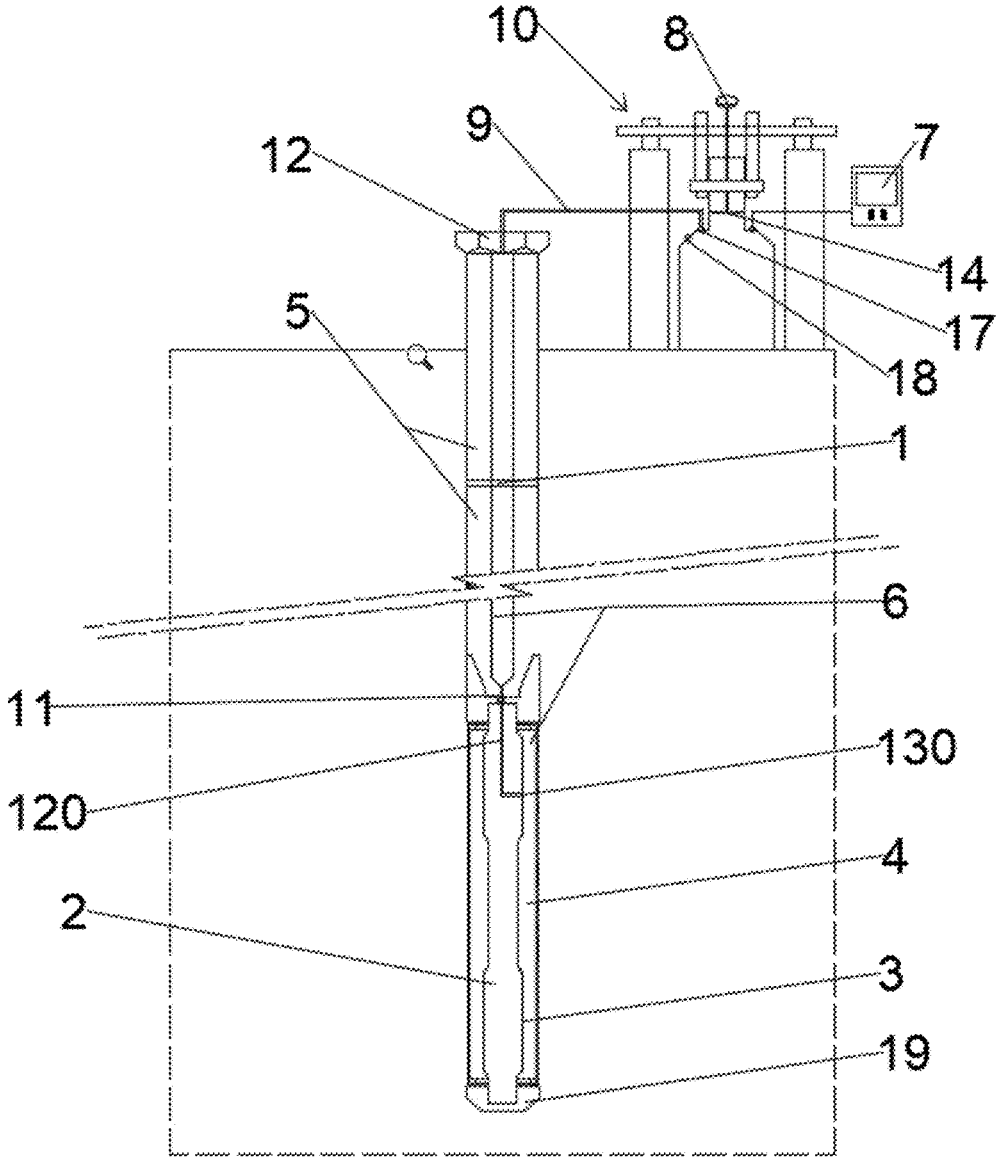
FIG. 2 is an isometric view of a pressure meter testing apparatus in accordance with one embodiment.
Figure 3:
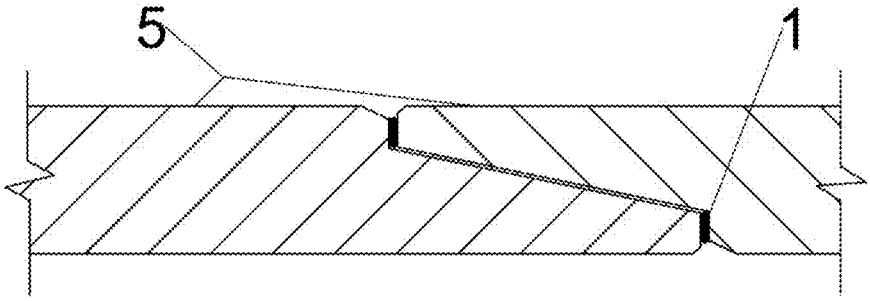
FIG. 3 is a cross-section view of gasket at the junctions of rigid drill pipes in FIG. 2.
Figure 6:
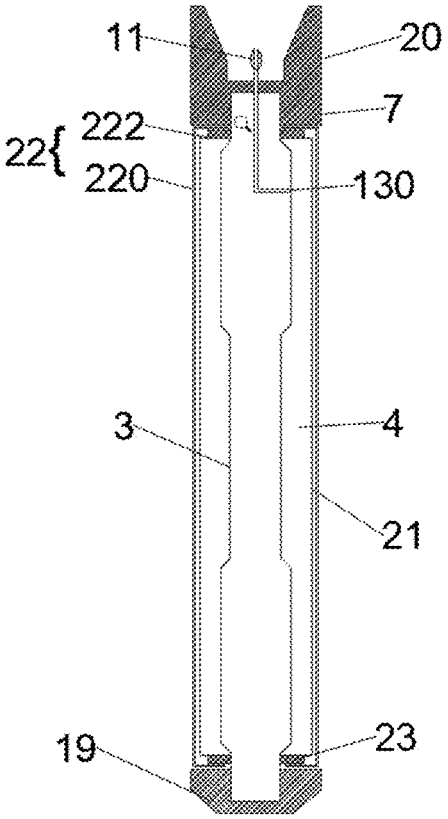
FIG. 6 is an isometric view of a of pressure meter of FIG. 2.
Figure 7:
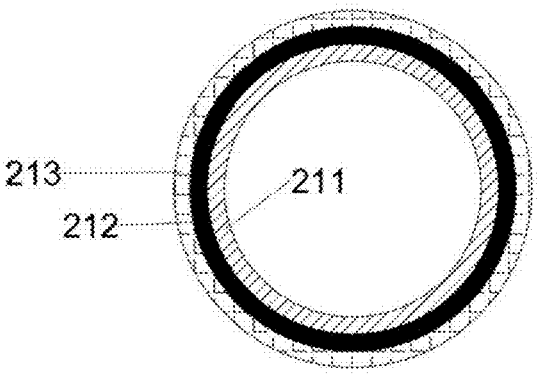
FIG. 7 is a cross-section view of elastic membrane of FIG. 6.
Figure 8:
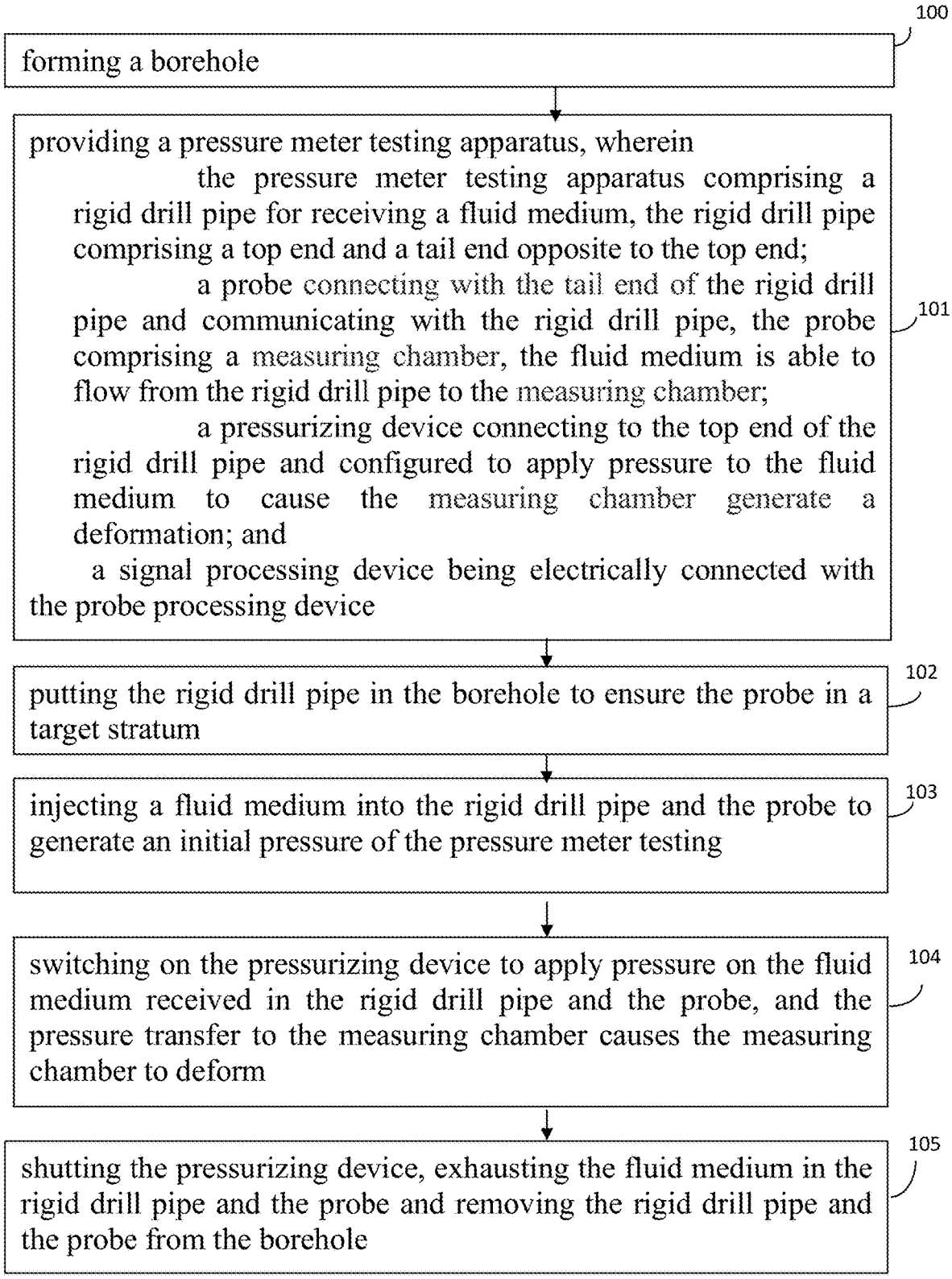
FIG. 8 is a flowchart of a pressure meter testing method for the pressure meter testing apparatus in FIG. 2.

As shown in FIG. 2 and FIG. 6, the probe 2 is connected with the tail end of the rigid drill pipe 5 via a joint 11, and communicates with the rigid drill pipe 5. Terminal end 19 of the probe 2 is a circular truncated cone shape. The hollow cavity of the drill pipe 5 closest to the probe 2 communicates with the probe 2 via a pipe 120. The pipe 120 is L-shape. During a pressure meter testing, the probe 2 locates in a target stratum, that is, the probe 2 is used to squeeze the target stratum to produce deformation, and to obtain mechanical properties of the target stratum. If the rigid drill pipe 5 includes a plurality of sub-drill pipes 51, the probe 2 is connected with a tail end of the lowest sub-drill pipe 51.

The probe 2 includes a hollow steel tube 3 and an elastic membrane 21 surrounding the hollow steel tube 3. Both ends of the hollow steel pipe 3 are thick and thin in the middle. A measuring chamber 4 is formed between an outer surface of the hollow steel tube 3 and an inner surface of the elastic membrane 21. In the embodiment, the hollow steel tube 3 includes a through hole 130 communicates with the measuring chamber 4. The pipe 120 connects the hollow cavity of the drill pipe 5 and the measuring chamber 4. The joint 11 has a through hole to communicate the drill pipe 5 and the probe 2, and the fluid medium 6 can flow from the drill pipe 5 into the measuring chamber 4 via the pipe 120 and the through hole 130, and the measuring chamber 4 is expanded under the fluid pressure 6, and then a deformation of the surrounding rock mass is produced.

As shown in FIG. 6, two ends of the elastic membrane 21 are set up with a rigid torus sheet 23 respectively, and a number of steel sheets 22 are set up around a circumference of the elastic membrane 21. In the embodiment, the elastic membrane 21 is bonded to the inner end of the rigid torus sheet 23 via cold sulphide binder. Cold sulphide binder has characteristics of waterproof, high strength, strong ability of bonding metal and rubber, so that the bonding portion 222 of the probe 2 will not be destroyed in the process of water injection to the pressure meter testing apparatus 100, and the sealing performance of the measuring chamber 4 will be guaranteed. The spacing between the two rigid torus sheets 23 is same with a thickness of the actual extruded soil layer. The steel sheet 22 includes a strip portion 220 and two bending portions 222 at both ends of the strip portion 220. The bending portion 222 is perpendicular to the strip portion 220. The bending portion 222 is fixed with the rigid torus sheet 23. The strip portion 220 surrounds the elastic membrane 21 to protect the elastic membrane 21 from damage under high pressure condition, and the bending portion 222 locates at the end portion of the measuring chamber 4, and the bending portion 222 is configured to limit the elastic membrane 21 only expand outwards along the radial direction. The number of strip steel sheets 22 are spliced with each other to form a seamless steel cylinder at the periphery of the elastic membrane 21. It should be noted that there is a small overlap between adjacent strip steel sheets 22 to cope with the situation of the elastic membrane 21 expansion. The bending portion 222 at both ends of the steel sheets 22 can not only restrain the axial extrusion deformation of the elastic membrane 21, but also have no effect on the radial deformation of the elastic membrane 21.

In the embodiment, the steel sheets 22 are distributed around the elastic membrane 21 to protect the elastic membrane 21 from destroyed by surrounding soil. The steel sheets 22 are spliced together to form a seamless steel cylinder. Thereby, the elastic membrane 21 together with the strip steel sheets 22 on the periphery of the elastic membrane 21 to ensure the measuring chamber 4 meet a requirement of measuring the external expansion and extrusion the surrounding rock mass under the action of high pressure in the test.

In the embodiment, the elastic membrane 21 includes a first membrane 211, a second membrane 212, and a third membrane 213 sequentially arranged from inside to outside. The elastic membrane 21 is able to withstand a high pressure more than 35 MPa. The first membrane 211 and the second membrane 212 are both nitrile rubber membranes, and thickness of the first membrane 211 and the second membrane 212 is about in a range from 2 to 3 mm, preferably 2.5 mm. The third membrane 213 is a nitrile rubber membrane mixed with an aramid fiber (i.e., polyethylene terephthalate), and thickness of the third membrane 213 is about in a range from 2 to 3 mm, preferably 2.5 mm.

Figure 5:
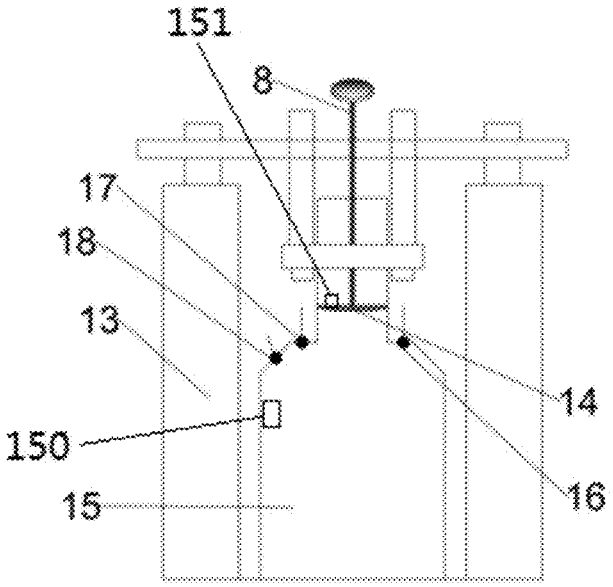
FIG. 5 is an isometric view of a of pressurizing device comprising in the pressure meter testing apparatus of FIG. 2.

The pressurizing device 10 is connected to the rigid drill pipe 5 via the communicating pipe 9. As shown in FIG. 4, a diameter of the communicating pipe 9 is the same as a diameter of the through hole of the bolt 12 to ensure sealing of the connection between the communicating pipe 9 and the bolt 12. As shown in FIG. 5, in the embodiment, the pressurizing device 10 includes at least one pressure unit 13, a piston rod 8, a piston head 14, a receiving chamber 15, a data transmission interface 16, an inlet 17, and an outlet 18.

One end of the piston rod 8 is inserted in the receiving chamber 15 to connect with the piston head 14, the other end is connected with the pressure unit 13. The pressure unit 13 is configured to drive the piston rod 8 to move up and down, and the piston head 14 can move up and down along a neck of the receiving chamber 15 with the moving of the piston rod 8, and compress fluid medium saved in the receiving chamber 15. The fluid medium 6 is able to be injected from the receiving chamber 15 into the rigid drill pipe 5 via the communicating pipe 9.

When the fluid medium 6 in the receiving chamber is under pressure by the pressure unit 13, the fluid medium 6 transmits the pressure to the measuring chamber 4 to cause it to expand, and the elastic membrane 21 with the steel sheet 22 on its outer side expand outward, and the deformation of the measuring chamber 4 can extrude surrounding soil. During the expansion, the bending portion 222 of the steel sheet 22 can limit the elastic membrane 21 expand along its axis direction, that is, the elastic membrane 21 can only expand along its radial direction. Therefore, the volume change of the measuring chamber 4 can only be caused along a radial direction, thus the accurate relation relationship between pressure and displacement deformation can be obtained, and the relevant parameters of the target stratum can be obtained.

The pressure unit 13 can be an oil cylinder and configured to apply pressure to the fluid medium 6 in the receiving chamber 15, and thereby pressure can be eventually transferred to the probe 2 of the PMT apparatus 100 via the communicating pipe 9 and the rigid drill pipe 5.

The inlet 17 is opened at the main body of the receiving chamber 15 and connected to the bolt 12 via the communicating pipe 9. Fluid medium can be injected into the receiving chamber 15 through the outlet 18, and the fluid medium 6 in the receiving chamber 15 is able to be injected into the rigid drill pipe 5 and the probe 2 through the inlet 17.

The receiving chamber 15 is equipped with a pressure sensor 150 and a displacement sensor 151. The pressure sensor 150 is used to detect the pressure change of the fluid medium 6, and the displacement sensor 151 is configured to detect the displacement change of the piston head 14 to indirectly detect the volume change of the probe 2. The pressure sensor 150 and the displacement sensor 151 are electrically connected to the data transmission interface 16 to output the data, and the data transmission interface 16 is electrically connected to the signal processing device 7.

The signal processing device 7 is used to receive a date of displacement change of the piston head 14 from the displacement sensor 151 and a pressure change data of the receiving chamber 15 from the pressure sensor 150. Specifically, by connecting the signal processing device 7 to the signal transmission interface 16, the mechanical characteristics of the target stratum, are analyzed by real-time information collected by the pressure sensor and the displacement sensor.

Referring to FIG. 9, a flowchart of a PMT method in a preferred embodiment of the present invention includes the steps of:

Step S100: A borehole is formed. The borehole can be formed using a drilling equipment.

Step S101: A number of sub-drill pipes are connected in turn to form the probe 2 connected at the tail end of the rigid drill pipe 5 and the rigid drill pipe 5. The number of sub-drill pipes 51 is determined by the depth of the target detection layer, and a gasket 1 is installed at the connection between each two the sub-drill pipes 51, and the rigid drill pipe 5 with the probe 2 is put into the borehole to ensure the probe in a target stratum.

Step S102: the inlet 17 of the pressurizing equipment 10 is connected to the bolt 12 of the rigid drill pipe 5.

Step S103: a fluid medium 6 is injected into the rigid drill pipe 6 and the air inside of the rigid drill pipe 5 and the probe 12 are emptied by the fluid medium 6 to generate an initial pressure of the pressure meter testing. By the way, the fluid medium 6 can be water.

Step S104: a pressure from the pressurizing device 10 is applied on the fluid medium 6, and the fluid medium 6 transmits the pressure to the measuring chamber 4 of the probe 2, and the pressure causes the measuring chamber 4 to expand and squeeze the surrounding rock and soil, causing a deformation of the target stratum.

Step S105: data about a radial deformation of the measuring chamber 4 of the probe 2 at different pressures is obtained.

Step S106: the testing data is saved, the pressure of the pressurizing device 10 begin to be reduced, the outlet is opened, the fluid medium is drained, the rigid drill pipe and the probe 2 are removed from the borehole in turn, and the connection interface are turned off, and the test is ended.

The embodiments shown and described above are only examples. Therefore, many commonly-known features and details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will, therefore, be appreciated that the embodiments described above may be modified within the scope of the claims.

What is claimed is:

1. A high-efficiency pre-drilling pressure meter test apparatus for deep rock mass comprising:

a rigid drill pipe for receiving a fluid medium, the rigid drill pipe comprising a top end and a tail end opposite to the top end;

a probe connecting with the tail end of the rigid drill pipe and communicating with the rigid drill pipe, the probe comprising a measuring chamber, the fluid medium is able to flow from the rigid drill pipe to the measuring chamber;

a pressurizing device connecting to the top end of the rigid drill pipe and configured to apply pressure to the fluid medium in the measuring chamber to cause the measuring chamber generate deformation; and a signal processing device being electrically connected with the pressurizing device, the signal processing device is configured to process deformation data generated by the pressurizing device;

wherein the pressurizing device comprises at least one pressure unit, a receiving chamber connected with the rigid drill pipe, a piston rod inserted in the receiving chamber and a piston head connected with the piston rod, the pressure unit is configured to drive the piston rod to move up and down, the piston head is able to move up and down along the chamber with the moving of the piston rod, the pressure unit is configured to apply pressure to the fluid medium in the receiving chamber, and the pressure is able to be transferred to the probe, the receiving chamber comprises an inlet, an outlet and a data transmission interface connected, the inlet connects to the rigid drill pipe, a fluid medium is injected into the receiving chamber through the outlet, and the fluid medium is injected into the rigid drill pipe through the inlet, the data transmission interface is electrically connected to the signal processing device.

2. The pressure meter testing apparatus of claim 1, wherein:

the rigid drill pipe comprises a plurality of sub-drill pipes connecting sequentially, connections at each two adjacent sub-drill pipes is provided with a gasket, the gasket is provided with a through hole at the central thereof to permit the fluid medium flow to the probe.

3. The pressure meter test apparatus of claim 2, wherein:

the receiving chamber is equipped with a pressure sensor and a displacement sensor, the pressure sensor is used to detect a pressure change of the receiving chamber, and the displacement sensor is configured to detect a displacement change of the piston head to indirectly measure the volume change of the probe.

4. The pressure meter test apparatus of claim 3, wherein:

the probe comprises a hollow steel tube and an elastic membrane surrounding the hollow steel tube, and the measuring chamber is formed between an outer surface of the hollow steel tube and an inner surface of the elastic membrane.

5. The pressure meter test apparatus of claim 4, wherein:

two ends of the elastic membrane are bonded to a rigid torus sheet.

6. The pressure meter test apparatus of claim 5, wherein:

a number of steel sheets are set up around a circumference of the elastic membrane.

7. The pressure meter test apparatus of claim 6, wherein:

the steel sheet comprises a strip portion and two bending portions at opposite ends of the strip portion, the bending portion perpendicular to the strip portion, and the bending portion is embedded between the rigid torus sheet and the tail end of the probe, the strip portion surrounds the elastic membrane.

8. The pressure meter test apparatus of claim 4, wherein:

the elastic membrane comprises a first membrane, a second membrane, and a third membrane sequentially arranged from inside to outside.

9. The pressure meter test apparatus of claim 8, wherein:

the first membrane and the second membrane are made from nitrile rubber, and both the first membrane and the second membrane have a thickness in a range from 2 to 3 mm.

10. The pressure meter test apparatus of claim 8, wherein:

the third membrane is made from a nitrile rubber mixed with an aramid fiber, and a thickness of the third membrane is in a range from 2 to 3 mm.

11. The pressure meter test apparatus of claim 8, wherein:

the gasket is made from nitrile rubber.

12. The pressure meter test apparatus of claim 1, wherein:

a terminal end of the probe is a circular truncated cone shape.

13. A pressure meter test method comprising:

forming a borehole;

providing a pressure meter test apparatus, wherein the pressure meter test apparatus comprising a rigid drill pipe for receiving a fluid medium, the rigid drill pipe comprising a top end and a tail end opposite to the top end;

a probe connecting with the tail end of the rigid drill pipe and communicating with the rigid drill pipe, the probe comprising a measuring chamber, the fluid medium is able to flow from the rigid drill pipe to the measuring chamber;

a pressurizing device connecting to the top end of the rigid drill pipe and configured to apply pressure to the fluid medium to cause the measuring chamber a deformation; and a signal processing device being electrically connected with the probe processing device;

putting the rigid drill pipe in the borehole to ensure the probe in a target stratum;

injecting a fluid medium into the rigid drill pipe and the probe to generate an initial pressure of the pressure meter testing;

switching on the pressurizing device to apply pressure on the fluid medium received in the rigid drill pipe and the probe, and the pressure transferred to the measuring chamber causes the measuring chamber to deform; and shutting the pressurizing device, exhausting the fluid medium in the rigid drill pipe and the probe and removing the rigid drill pipe and the probe from the borehole.

14. The method of claim 13, wherein:

the pressurizing device comprises at least one pressure unit, a receiving chamber connected with the rigid drill pipe, a piston rod inserted in the receiving chamber and a piston head connected with the piston rod, the pressure unit is configured to drive the piston rod to move up and down, the piston head is able to move up and down along the chamber with the moving of the piston rod, the pressure unit is configured to apply pressure to the fluid medium in the receiving chamber, and the pressure is able to transfer to the probe.

15. The method of claim 14, wherein:

the receiving chamber comprises an inlet, an outlet and a data transmission interface connected, the inlet connects to the rigid drill pipe, a fluid medium is injected into the receiving chamber through the outlet, and the fluid medium is injected into the rigid drill pipe through the inlet, the data transmission interface is electrically connected to the signal processing device.

16. The method of claim 15, wherein:

the rigid drill pipe comprises a plurality of sub-drill pipes connecting sequentially, connections at each two adjacent sub-drill pipes is provided with a gasket, the gasket is provided with a through hole at the central thereof to permit the fluid medium flow to the probe.

* * * * *